US010150228B1

(12) United States Patent
Aleman

(10) Patent No.: US 10,150,228 B1
(45) Date of Patent: Dec. 11, 2018

(54) MULTI-POSITION ARTICULATING CLAMP AND ASSOCIATED USE THEREOF

(71) Applicant: Alvaro Aleman, Whittier, CA (US)

(72) Inventor: Alvaro Aleman, Whittier, CA (US)

( * ) Notice: Subject to any disclaimer, the term of this patent is extended or adjusted under 35 U.S.C. 154(b) by 42 days.

(21) Appl. No.: 15/499,822

(22) Filed: Apr. 27, 2017

Related U.S. Application Data

(60) Provisional application No. 62/328,173, filed on Apr. 27, 2016.

(51) Int. Cl.
*B28D 7/04* (2006.01)
*B25B 1/22* (2006.01)

(52) U.S. Cl.
CPC ..... *B28D 7/043* (2013.01); *B25B 1/22* (2013.01)

(58) Field of Classification Search
CPC ..... B28D 7/04; B28D 7/00; B28D 7/043
USPC ..... 125/35; 269/164, 223, 307, 56, 72, 73, 269/79, 82; 83/464, 522.18; 451/365
See application file for complete search history.

(56) References Cited

U.S. PATENT DOCUMENTS 1,355,809 A * 10/1920 Bryant ..... B23Q 1/525 33/537
2,464,117 A * 3/1949 Coates ..... B28D 7/043 125/13.01
2,947,214 A * 8/1960 Schwuttke ..... C30B 33/00 125/35
3,089,478 A * 5/1963 Jones ..... B28D 7/043 125/35
3,168,893 A * 2/1965 Johnson ..... B28D 5/0088 125/13.01
3,463,137 A * 8/1969 Hare ..... B28D 7/043 125/35
4,275,777 A * 6/1981 Briggs ..... B23D 59/00 144/1.1
4,315,494 A * 2/1982 DiPlacido ..... B28D 7/043 125/13.01
4,558,853 A * 12/1985 Janerstal ..... B23Q 16/001 269/71
4,924,843 A * 5/1990 Waren ..... B28D 1/047 125/35
7,011,085 B1 * 3/2006 Lochotzki ..... B28D 7/04 125/23.02
7,066,068 B1 * 6/2006 Caldwell ..... B27B 5/222 125/12
7,219,585 B1 * 5/2007 Kelly ..... B23D 45/021 125/13.01

(Continued)

*Primary Examiner* — George Nguyen
(74) *Attorney, Agent, or Firm* — Ashkan Najafi

(57) ABSTRACT

The multi-position, articulating clamp includes a plate disposed on a first plane, a first brick-holding jig adjustably coupled to the plate, and a second brick-holding jig adjustably coupled to the plate. Advantageously, each of the first brick-holding jig and the second brick-holding jig is selectively reciprocated along the plate and along a bidirectional linear path registered parallel to the first plane. Advantageously, each of the first brick-holding jig and the second brick-holding jig is selectively rotated along the plate and along an arcuate path registered planar to the first plane. Advantageously, each of the first brick-holding jig and the second brick-holding jig is selectively tilted along a second plane registered non-parallel to the first plane.

19 Claims, 8 Drawing Sheets

(56) References Cited

U.S. PATENT DOCUMENTS

| | | | | |
|---|---|---|---|---|
| 8,910,358 | B2 * | 12/2014 | Piepenburg | F28F 9/007 269/155 |
| 2012/0227726 | A1 * | 9/2012 | Higgins | B28D 1/047 125/14 |

* cited by examiner

MULTI-POSITION ARTICULATING CLAMP AND ASSOCIATED USE THEREOF

CROSS REFERENCE TO RELATED APPLICATIONS

This is a non-provisional patent application that claims the benefit of U.S. provisional patent application No. 62/328,173 filed Apr. 27, 2016, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to cutting tool accessories and, more particularly, to a multi-position, articulating clamp for holding bricks throughout the process of cutting them and thereby facilitating a variety of cuts—while enabling the user to position and hold the brick in a hands-free manner. The multi-position, articulating clamp permits bricklayers and masons to achieve clean and consistent cuts, without endangering their fingers.

Prior Art

Often, disclosures are the inspiration of persons who work daily in a specialized field or trade, and create—out of necessity, frustration, and imagination—a new and better tool or method for improving their working life and that of their co-workers. One such improvement—designed to make the work of the bricklayer or mason easier, more consistent, and safer—is the subject of this report. The need for this disclosure arises from the need of these craftsmen to cut bricks and blocks in a variety of ways—straight and angled cuts, curved and rounded cuts, compound cuts—generally involving the use of a handheld rotary grinder and masonry blades.

The trouble with this practice is that the worker must position and hold the brick in place by hand—putting his fingers and hand at risk of a serious cut. The disclosure to be presented and considered in the course of this report would eliminate that hazard, and do so while facilitating clean, more consistent dressing of bricks.

Accordingly, a need remains for a multi-position, articulating clamp in order to overcome at least one aforementioned shortcoming. The exemplary embodiment(s) satisfy such a need by providing a multi-position, articulating clamp for holding bricks throughout the process of cutting them and thereby facilitating a variety of cuts—while enabling the user to position and hold the brick in a hands-free manner. that is convenient and easy to use, lightweight yet durable in design, versatile in its applications, and designed for permitting bricklayers and masons to achieve clean and consistent cuts, without endangering their fingers.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a multi-position, articulating clamp for holding and facilitating a variety of cuts into an existing brick while enabling a user to position and support the existing brick in a hands-free manner. These and other objects, features, and advantages of the non-limiting exemplary embodiment(s) are provided by the multi-position, articulating clamp including a plate disposed on a first plane, a first brick-holding jig adjustably coupled to the plate, and a second brick-holding jig adjustably coupled to the plate. Advantageously, each of the first brick-holding jig and the second brick-holding jig is selectively reciprocated along the plate and along a bidirectional linear path registered parallel to the first plane. Advantageously, each of the first brick-holding jig and the second brick-holding jig is selectively rotated along the plate and along an arcuate path registered planar to the first plane. Advantageously, each of the first brick-holding jig and the second brick-holding jig is selectively tilted along a second plane registered non-parallel to the first plane.

In a non-limiting exemplary embodiment, the second plane is registered perpendicular to the first plane.

In a non-limiting exemplary embodiment, the plate includes a planar top surface having a centrally registered longitudinal axis, a plurality of linear longitudinal slots spaced apart and each oriented parallel to each of the centrally registered longitudinal axis and the bidirectional linear path, and a linear latitudinal slot registered orthogonal to the bidirectional linear path.

In a non-limiting exemplary embodiment, each of the first brick-holding jig and the second brick-holding jig includes a bidirectional linear displacement mechanism having a rotatable handle disposed exterior of an end of the plate, a worm gear located along a bottom side of the plate and operably coupled to the rotatable handle, and an upper bracket slidably positioned on a top side of the plate.

In a non-limiting exemplary embodiment, a lower bracket is under-mounted to the bottom side of the plate and connected to the worm gear. In this manner, the lower bracket is partially traversed upwardly through the plurality of slots and statically affixed to the lower bracket so that first brick-holding jig and the second brick-holding jig can be displaced along the bidirectional rotational path one at a time.

In a non-limiting exemplary embodiment, each of the first brick-holding jig and the second brick-holding jig further includes a rotation mechanism including a support arm seated on the top surface of the plate, an arcuate panel statically mated to a lateral end of the support arm, an axle fixedly attached to a medial end of the support arm, and a disc having a central aperture rotatably engaged with the axle such that the disc is oriented parallel to the first plane. In this manner, the disc rotates in clockwise and counter clockwise directions relative to the axle.

In a non-limiting exemplary embodiment, each of the first brick-holding jig and the second brick-holding jig further includes a tilting mechanism selectively displaced along a first axis, a second axis and a third axis each registered orthogonal to the bidirectional linear path and parallel to the first plane.

In a non-limiting exemplary embodiment, the tilting mechanism includes a plurality of support arms fixedly coupled to a top surface of the disc, a first anchor bracket fixedly coupled to the top surface of the disc and intermediately positioned between the support arms, an elongated lever having a distal end adjustably coupled to the first anchor bracket and further having a linear longitudinal opening, a second anchor bracket adjustably coupled to the elongated lever along the linear longitudinal opening, and a brick-holding member fixedly mated to the second anchor bracket and selectively tilted towards and away from the linear latitudinal slot.

In a non-limiting exemplary embodiment, the brick-holding member includes at least one support bracket, a linear rod traversed through the support arms and the support bracket wherein the linear rod has a longitudinal length registered orthogonal to the bidirectional linear path, and a friction-inducing member configured to maintain the existing brick at a substantially stable position during cutting operations.

The present disclosure further includes method of utilizing a multi-position, articulating clamp for holding and facilitating a variety of cuts into an existing brick while enabling a user to position and support the existing brick in a hands-free manner. Such a method includes the steps of: providing and disposing a plate on a first plane; providing and adjustably coupling a first brick-holding jig to the plate; providing and adjustably coupling a second brick-holding jig to the plate; selectively reciprocating each of the first brick-holding jig and the second brick-holding jig along the plate and along a bidirectional linear path registered parallel to the first plane; selectively rotating each of the first brick-holding jig and the second brick-holding jig along the plate and along an arcuate path registered planar to the first plane; and selectively tilting each of the first brick-holding jig and the second brick-holding jig along a second plane registered non-parallel to the first plane.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

FIG. 1 is a perspective view of a multi-position, articulating clamp, in accordance with a non-limiting exemplary embodiment;

FIG. 1*a* is an enlarged partial view of the multi-position, articulating clamp shown in FIG. 1;

FIG. 2 is a perspective view of a multi-position, articulating clamp, in accordance with another non-limiting exemplary embodiment;

FIG. 2*a* is an enlarged partial view of the multi-position, articulating clamp shown in FIG. 2;

FIG. 3 is a perspective view of a multi-position, articulating clamp shown in FIG. 2, employing an alternate friction-inducing member, in accordance with a non-limiting exemplary embodiment;

FIG. 3*a* is an enlarged partial view of the multi-position, articulating clamp shown in FIG. 3;

Figure 1:
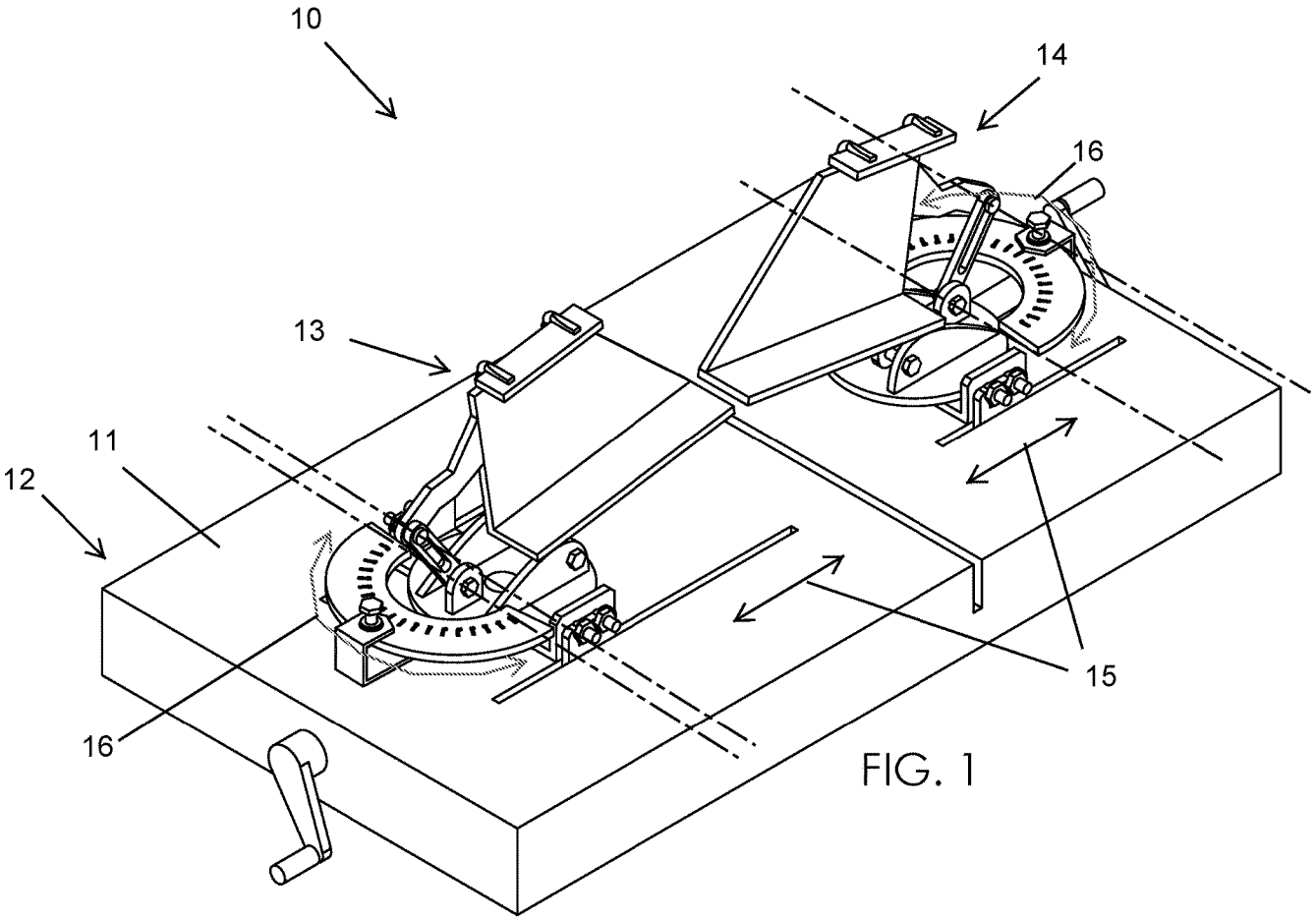
Figure 1A:
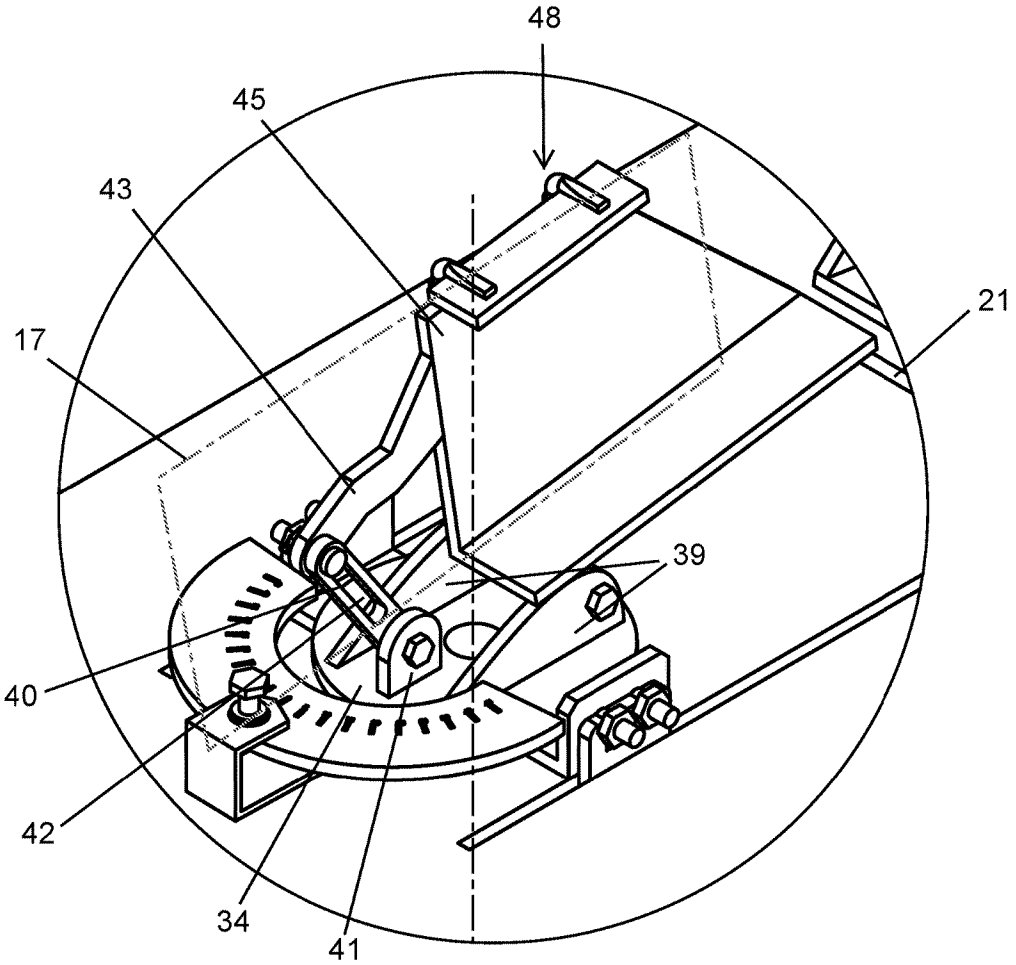

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means ±15% of the numerical.

If used herein, "substantially" means largely if not wholly that which is specified but so close that the difference is insignificant.

Figure 2:
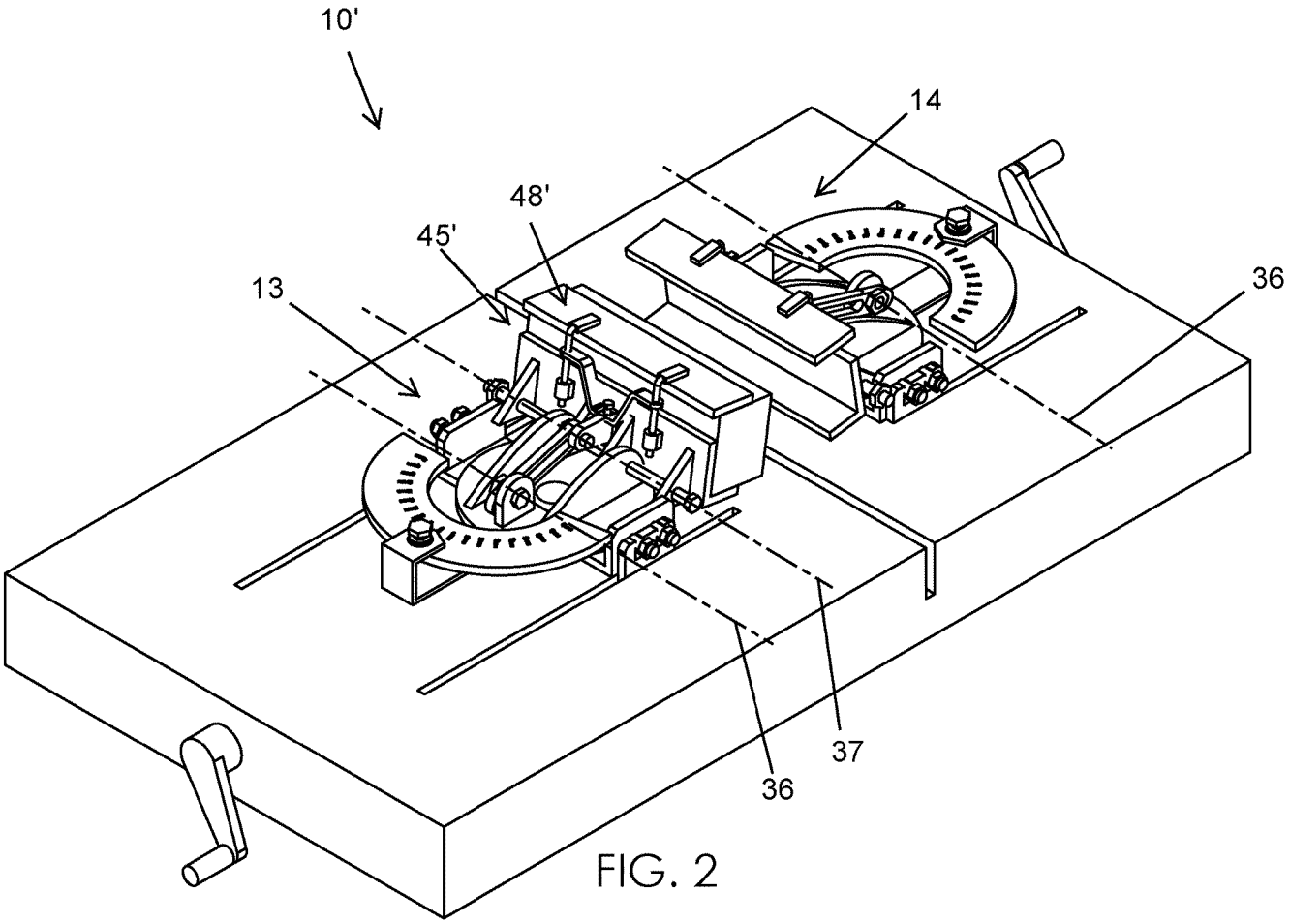
Figure 2A:
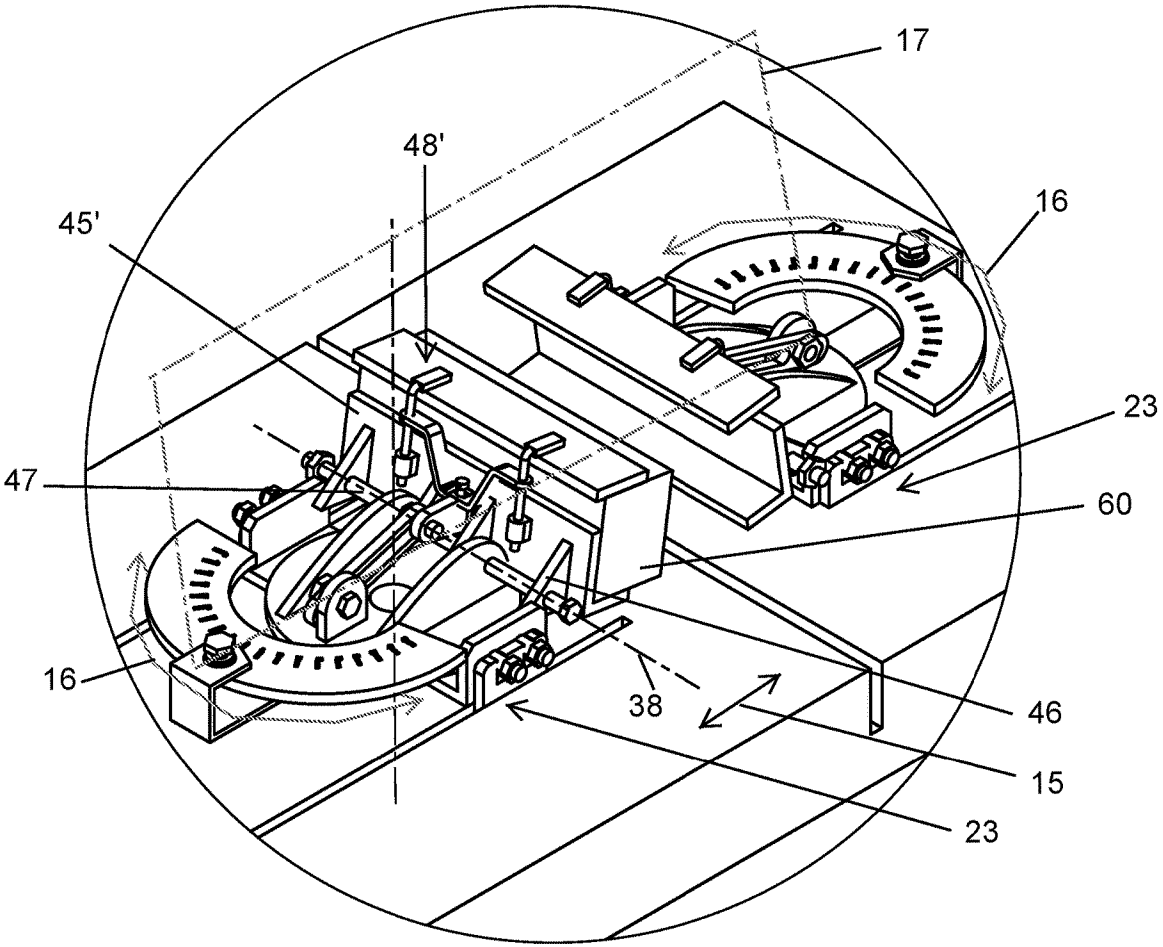
Figure 3:
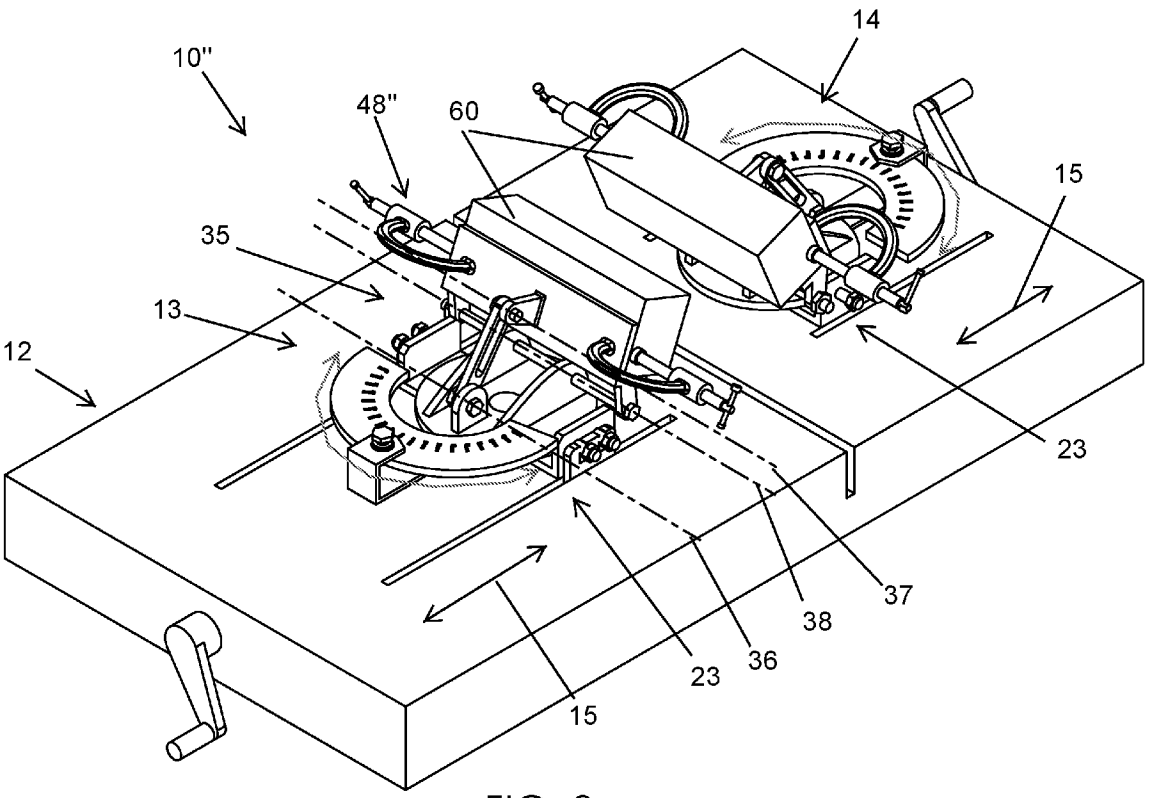
Figure 3A:
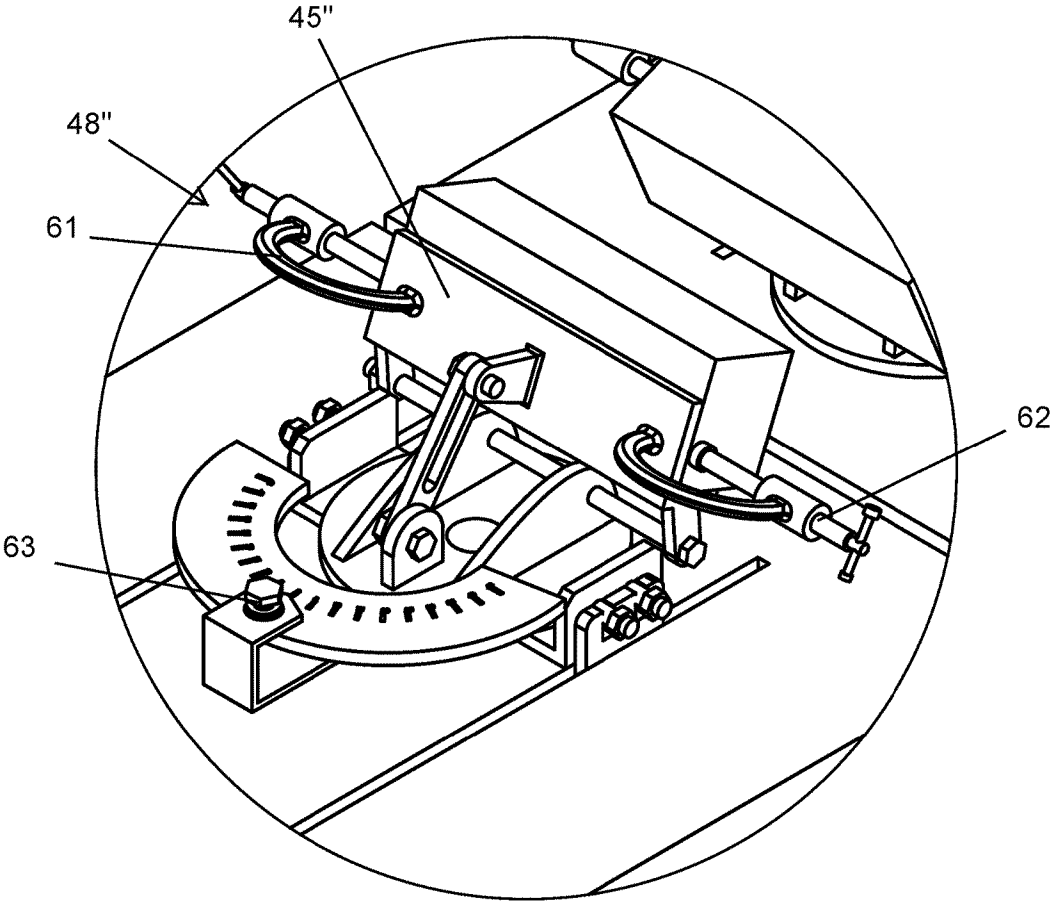
Figure 4:
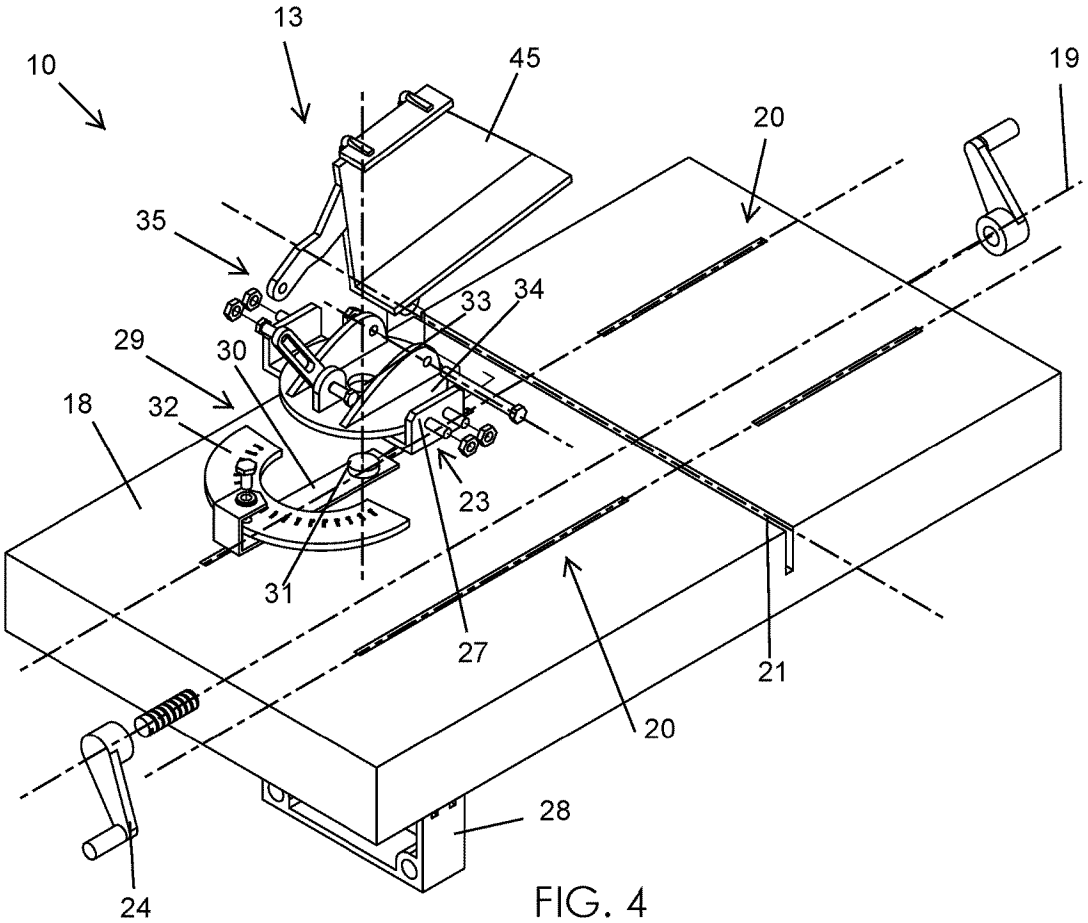
FIG. 4 is an exploded view of the multi-position, articulating clamp shown in FIG. 1 wherein the second brick-holding is detached from the plate.
Figure 6:
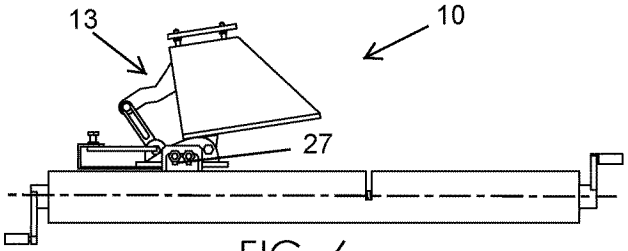
FIG. 6 is a side elevational view of the multi-position, articulating clamp shown in FIG. 4.
Figure 8:
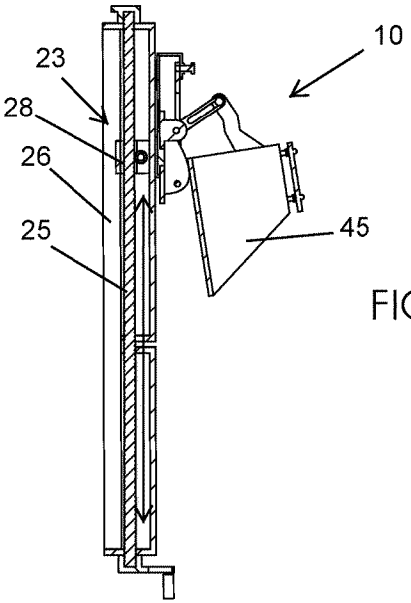
FIG. 8 is a cross-sectional view of the multi-position, articulating clamp taken along line 8-8 in FIG. 7.
Figure 5:
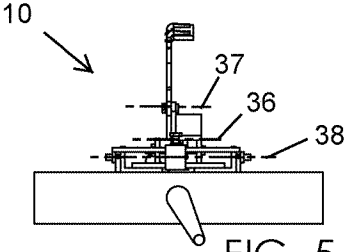
FIG. 5 is a front elevational view of the multi-position, articulating clamp shown in FIG. 4.
Figure 7:
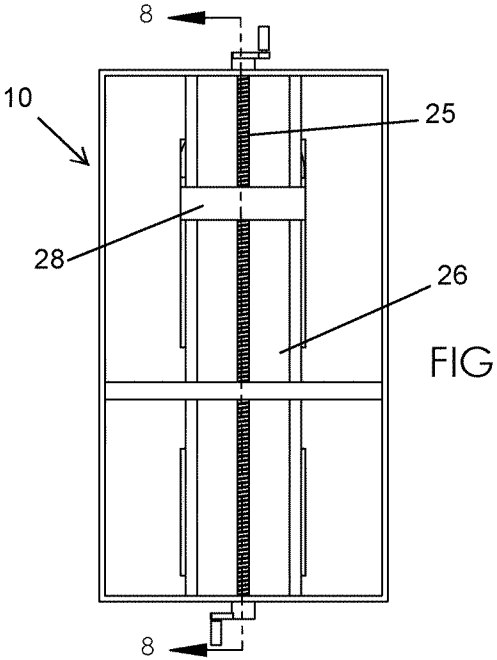
FIG. 7 is a bottom plan view of the multi-position, articulating clamp shown in FIG. 4.

Non-limiting exemplary embodiment(s) of the present disclosure is referred to generally in FIGS. 1-8 and are intended to provide a multi-position, articulating clamp 10, 10', 10" for holding a brick 60 throughout the process of cutting them and thereby facilitating a variety of cuts—while enabling the user to position and hold the brick 60 in a hands-free manner. The multi-position, articulating clamp 10, 10', 10" permits bricklayers and masons to achieve clean and consistent cuts, without endangering their fingers. It should be understood that the exemplary embodiment(s) may be used to cut a variety of bricks, and should not be limited to any particular brick described herein.

The non-limiting exemplary embodiment(s) is/are referred to generally in FIGS. 1-8 and is/are intended to provide a multi-position, articulating clamp 10, 10', 10" for holding and facilitating a variety of cuts into an existing brick 60 while enabling a user to position and support the existing brick 60 in a hands-free manner. The multi-position, articulating clamp 10, 10', 10" includes a plate 11 disposed on a first plane 12, a first brick-holding jig 13 adjustably coupled to the plate 11, and a second brick-holding jig 14 adjustably coupled to the plate 11. Advantageously, each of the first brick-holding jig 13 and the second brick-holding jig 14 is selectively reciprocated along the plate 11 and along a bidirectional linear path 15 registered parallel to the first plane 12. Advantageously, each of the first brick-holding jig 13 and the second brick-holding jig 14 is selectively rotated along the plate 11 and along an arcuate path 16 registered planar to the first plane 12. Advantageously, each of the first brick-holding jig 13 and the second brick-holding jig 14 is selectively tilted along a second plane 17 registered non-parallel to the first plane 12.

In a non-limiting exemplary embodiment, the second plane 17 is registered perpendicular to the first plane 12.

In a non-limiting exemplary embodiment, the plate 11 includes a planar top surface 18 having a centrally registered longitudinal axis 19, a plurality of linear longitudinal slots 20 spaced apart and each oriented parallel to each of the centrally registered longitudinal axis 19 and the bidirectional linear path 15, and a linear latitudinal slot 21 registered orthogonal to the bidirectional linear path 15.

In a non-limiting exemplary embodiment, each of the first brick-holding jig 13 and the second brick-holding jig 14 includes a bidirectional linear displacement mechanism 23 having a rotatable handle 24 disposed exterior of an end of the plate 11, a worm gear 25 located along a bottom side 26 of the plate 11 and operably coupled to the rotatable handle 24, and an upper bracket 27 slidably positioned on a top side of the plate 11.

In a non-limiting exemplary embodiment, a lower bracket 28 is under-mounted to the bottom side 26 of the plate 11 and connected to the worm gear 25. In this manner, the lower bracket 28 is partially traversed upwardly through the plurality of longitudinal slots 20 and statically affixed to the upper bracket 27 so that first brick-holding jig 13 and the second brick-holding jig 14 can be displaced along the bidirectional linear path 15 one at a time.

In a non-limiting exemplary embodiment, each of the first brick-holding jig 13 and the second brick-holding jig 14 further includes a rotation mechanism 29 including a support arm 30 seated on the top surface 18 of the plate 11, an arcuate panel 32 statically mated to a lateral end of the support arm 30, an axle 31 fixedly attached to a medial end of the support arm 30, and a disc 34 having a central aperture 33 rotatably engaged with the axle 31 such that the disc 34 is oriented parallel to the first plane 12. In this manner, the disc 34 rotates in clockwise and counter clockwise directions relative to the axle 31.

In a non-limiting exemplary embodiment, each of the first brick-holding jig 13 and the second brick-holding jig 14 further includes a tilting mechanism 35 selectively displaced along a first axis 36, a second axis 37 and a third axis 38 each registered orthogonal to the bidirectional linear path 15 and parallel to the first plane 12.

In a non-limiting exemplary embodiment, the tilting mechanism 35 includes a plurality of support arms 39 fixedly coupled to a top surface of the disc 34, a first anchor bracket 41 fixedly coupled to the top surface of the disc 34 and intermediately positioned between the support arms 39, an elongated lever 40 having a distal end adjustably coupled to the first anchor bracket 41 and further having a linear longitudinal opening 42, a second anchor bracket 43 adjustably coupled to the elongated lever 40 along the linear longitudinal opening 42, and a brick-holding member 45, 45', 45" fixedly mated to the second anchor bracket 43 and selectively tilted towards and away from the linear latitudinal slot 21.

In a non-limiting exemplary embodiment, the brick-holding member 45, 45', 45" includes at least one support bracket 46, a linear rod 47 traversed through the support arms 39 and the support bracket 46 wherein the linear rod 47 has a longitudinal length registered orthogonal to the bidirectional linear path 15, and a friction-inducing member 48, 48', 48" configured to maintain the existing brick 60 at a substantially stable position during cutting operations.

The present disclosure further includes method of utilizing a multi-position, articulating clamp 10, 10', 10" for holding and facilitating a variety of cuts into an existing brick 60 while enabling a user to position and support the existing brick 60 in a hands-free manner. Such a method includes the steps of: providing and disposing a plate 11 on a first plane 12; providing and adjustably coupling a first brick-holding jig 13 to the plate 11; providing and adjustably coupling a second brick-holding jig 14 to the plate 11; selectively reciprocating each of the first brick-holding jig 13 and the second brick-holding jig 14 along the plate 11 and along a bidirectional linear path 15 registered parallel to the first plane 12; selectively rotating each of the first brick-holding jig 13 and the second brick-holding jig 14 along the plate 11 and along an arcuate path 16 registered planar to the first plane 12; and selectively tilting each of the first brick-holding jig 13 and the second brick-holding jig 14 along a second plane 17 registered non-parallel to the first plane 12.

Referring to FIGS. 1-8 in general, in a non-limiting exemplary embodiment(s), the multi-position, adjustable clamping device 10, 10', 10" is shown for holding a variety of bricks securely and at a variety of orientations for the cuts which shape and dress the brick 60 prior to use. The multi-positional, articulating clamp 10, 10', 10" is constructed in tool-grade steel, and includes articulating, jigs 13, 14 mounted on a circular, flat steel disc 34. As an example, the device preferably measures 22 inches in length, 9 inches in width, and 8 inches in depth.

In a non-limiting exemplary embodiment, each jig 13, 14 may include a plurality of plates oriented at 90 degrees to one another to form an L-shaped bed or cradle 45, 45', 45" to hold the brick 60. The brick 60 is held in place by way of a variety of friction-inducing members 48, 48', 48" such as modified C-clamps, the frames of which are welded to the plates of the brick-holding member 45, 45', 45" (e.g. cradles), and the swivel-shoes 61 of which are tightened by tommy-bars 62 to press against the brick 60 on either end. A lock-down bolt 63 on the circular disc 34, when eased, permits the clamp 10, 10', 10" to be rotated on a horizontal plane (first plane 12); and the brick-holding member 45, 45', 45" are adjustable—by means of a locking, sliding, cantilevered arm—to a variety of angular orientations, from upright to descending/ascending tilts of 45 degrees. This permits the brick 60 to be held securely in a wide variety of positions for the easiest access to cutting.

Thus, a brick 60 scored and ready for cutting will simply be placed into the brick-holding member 45, 45', 45" (cradle) of the multi-positional, articulating clamp 10, 10', 10" and clamped securely. The worker will then adjust and position the multi-positional, articulating clamp 10, 10', 10" to the most convenient, comfortable orientation for cutting the brick 60 along the scores, then lock this position in place via the lock-bolts of the clamp 10, 10', 10", and then proceed to the cutting. The variety of positions of the multi-positional, articulating clamp 10, 10', 10" will facilitate not only straight cuts, but also angled, curved, and compound cuts.

The great advantages of the multi-positional, articulating clamp 10, 10', 10" are thus in the safety of the worker doing the cutting, and in the consistent accuracy facilitated in the cuts themselves. For the worker, not having to hold the brick 60 will mean, first, that his fingers and holding hand will be in no danger from the sawblade; and second, that his cuts will be clean and precise. For the contractor, whose employees use the multi-positional, articulating clamp 10, 10', 10", there will be fewer jobsite injuries and injury-caused absences, and far less waste of poorly cut brick 60. Therefore, the multi-positional, articulating clamp 10, 10', 10"—clever in conception, thoughtful in design, and conceived to meet a real need shared by bricklayers and masons the world over—should find an enthusiastic reception in a variety of construction-industry markets.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A multi-position, articulating clamp for holding and facilitating a variety of cuts into an existing brick while enabling a user to position and support the existing brick in a hands-free manner, said multi-position, articulating clamp comprising:

a plate disposed on a first plane;

a first brick-holding jig coupled to said plate; and a second brick-holding jig coupled to said plate;

wherein each of said first brick-holding jig and said second brick-holding jig is selectively reciprocated along a bidirectional linear path registered parallel to said first plane;

wherein each of said first brick-holding jig and said second brick-holding jig is selectively rotated along an arcuate path registered planar to said first plane;

wherein each of said first brick-holding jig and said second brick-holding jig is selectively tilted along a second plane registered non-parallel to said first plane.

2. The multi-position, articulating clamp of claim 1, wherein said second plane is registered perpendicular to said first plane.

3. The multi-position, articulating clamp of claim 1, wherein said plate comprises:

a planar top surface having a centrally registered longitudinal axis;

a plurality of linear longitudinal slots spaced apart and each oriented parallel to each of the centrally registered longitudinal axis and said bidirectional linear path; and a linear latitudinal slot registered orthogonal to said bidirectional linear path.

4. The multi-position, articulating clamp of claim 3, wherein each of said first brick-holding jig and said second brick-holding jig comprises: a bidirectional linear displacement mechanism including a rotatable handle disposed exterior of an end of said plate;

a worm gear located along a bottom side of said plate and operably coupled to said rotatable handle; and an upper bracket slidably positioned on a top side of said plate.

5. The multi-position, articulating clamp of claim 4, further comprising: a lower bracket under-mounted to said bottom side of said plate and connected to said worm gear;

wherein said lower bracket is partially traversed upwardly through said plurality of longitudinal slots and statically affixed to said upper bracket.

6. The multi-position, articulating clamp of claim 5, wherein each of said first brick-holding jig and said second brick-holding jig further comprises: a rotation mechanism including a support arm seated on said top surface of said plate;

an arcuate panel statically mated to a lateral end of said support arm;

an axle fixedly attached to a medial end of said support arm; and a disc having a central aperture rotatably engaged with said axle such that said disc is oriented parallel to said first plane;

wherein said disc rotates in clockwise and counter clockwise directions relative to said axle.

7. The multi-position, articulating clamp of claim 1, wherein each of said first brick-holding jig and said second brick-holding jig further comprises: a tilting mechanism selectively displaced along a first axis, a second axis and a third axis each registered orthogonal to said bidirectional linear path and parallel to said first plane.

8. The multi-position, articulating clamp of claim 7, wherein said tilting mechanism comprises:

a plurality of support arms fixedly coupled to a top surface of said disc;

a first anchor bracket fixedly coupled to said top surface of said disc and intermediately positioned between said support arms;

an elongated lever having a distal end adjustably coupled to said first anchor bracket and further having a linear longitudinal opening;

a second anchor bracket adjustably coupled to said elongated lever along said linear longitudinal opening; and a brick-holding member fixedly mated to said second anchor bracket and selectively tilted towards and away from said linear latitudinal slot.

9. The multi-position, articulating clamp of claim 8, wherein said brick-holding member comprises:

at least one support bracket;

a linear rod traversed through said support arms and said support bracket, said linear rod having a longitudinal length registered orthogonal to said bidirectional linear path; and a friction-inducing member configured to maintain the existing brick at a substantially stable position during cutting operations.

10. A multi-position, articulating clamp for holding and facilitating a variety of cuts into an existing brick while enabling a user to position and support the existing brick in a hands-free manner, said multi-position, articulating clamp comprising:

a plate disposed on a first plane;

a first brick-holding jig adjustably coupled to said plate; and a second brick-holding jig adjustably coupled to said plate;

wherein each of said first brick-holding jig and said second brick-holding jig is selectively reciprocated along said plate and along a bidirectional linear path registered parallel to said first plane;

wherein each of said first brick-holding jig and said second brick-holding jig is selectively rotated along said plate and along an arcuate path registered planar to said first plane;

wherein each of said first brick-holding jig and said second brick-holding jig is selectively tilted along a second plane registered non-parallel to said first plane.

11. The multi-position, articulating clamp of claim 10, wherein said second plane is registered perpendicular to said first plane.

12. The multi-position, articulating clamp of claim 10, wherein said plate comprises:

a planar top surface having a centrally registered longitudinal axis;

a plurality of linear longitudinal slots spaced apart and each oriented parallel to each of the centrally registered longitudinal axis and said bidirectional linear path; and a linear latitudinal slot registered orthogonal to said bidirectional linear path.

13. The multi-position, articulating clamp of claim 12, wherein each of said first brick-holding jig and said second brick-holding jig comprises: a bidirectional linear displacement mechanism including a rotatable handle disposed exterior of an end of said plate;

a worm gear located along a bottom side of said plate and operably coupled to said rotatable handle; and an upper bracket slidably positioned on a top side of said plate.

14. The multi-position, articulating clamp of claim 13, further comprising: a lower bracket under-mounted to said bottom side of said plate and connected to said worm gear;

wherein said lower bracket is partially traversed upwardly through said plurality of longitudinal slots and statically affixed to said upper bracket.

15. The multi-position, articulating clamp of claim 14, wherein each of said first brick-holding jig and said second brick-holding jig further comprises: a rotation mechanism including a support arm seated on said top surface of said plate;

an arcuate panel statically mated to a lateral end of said support arm;

an axle fixedly attached to a medial end of said support arm; and a disc having a central aperture rotatably engaged with said axle such that said disc is oriented parallel to said first plane;

wherein said disc rotates in clockwise and counter clockwise directions relative to said axle.

16. The multi-position, articulating clamp of claim 10, wherein each of said first brick-holding jig and said second brick-holding jig further comprises: a tilting mechanism selectively displaced along a first axis, a second axis and a third axis each registered orthogonal to said bidirectional linear path and parallel to said first plane.

17. The multi-position, articulating clamp of claim 16, wherein said tilting mechanism comprises:

a plurality of support arms fixedly coupled to a top surface of said disc;

a first anchor bracket fixedly coupled to said top surface of said disc and intermediately positioned between said support arms;

an elongated lever having a distal end adjustably coupled to said first anchor bracket and further having a linear longitudinal opening;

a second anchor bracket adjustably coupled to said elongated lever along said linear longitudinal opening; and a brick-holding member fixedly mated to said second anchor bracket and selectively tilted towards and away from said linear latitudinal slot.

18. The multi-position, articulating clamp of claim 17, wherein said brick-holding member comprises:

at least one support bracket;

a linear rod traversed through said support arms and said support bracket, said linear rod having a longitudinal length registered orthogonal to said bidirectional linear path; and a friction-inducing member configured to maintain the existing brick at a substantially stable position during cutting operations.

19. A method of utilizing a multi-position, articulating clamp for holding and facilitating a variety of cuts into an existing brick while enabling a user to position and support the existing brick in a hands-free manner, said method comprising the steps of:

providing and disposing a plate on a first plane;

providing and adjustably coupling a first brick-holding jig to said plate;

providing and adjustably coupling a second brick-holding jig to said plate;

selectively reciprocating each of said first brick-holding jig and said second brick-holding jig along said plate and along a bidirectional linear path registered parallel to said first plane;

selectively rotating each of said first brick-holding jig and said second brick-holding jig along said plate and along an arcuate path registered planar to said first plane; and selectively tilting each of said first brick-holding jig and said second brick-holding jig along a second plane registered non-parallel to said first plane.

* * * * *